US006722495B2

(12) United States Patent
Fresnel

(10) Patent No.: US 6,722,495 B2
(45) Date of Patent: Apr. 20, 2004

(54) ENVELOPE FOR PACKAGING AT LEAST ONE ARTICLE, THE ENVELOPE BEING OF THE TYPE CONSTITUTED BY A SLEEVE OF HEAT SHRINK PLASTIC MATERIAL

(75) Inventor: Eric Fresnel, Paris (FR)

(73) Assignee: Sleever International Company, Paris (FR)

( * ) Notice: Subject to any disclaimer, the term of this patent is extended or adjusted under 35 U.S.C. 154(b) by 0 days.

(21) Appl. No.: 10/311,417

(22) PCT Filed: Jun. 14, 2001

(86) PCT No.: PCT/FR01/01851

§ 371 (c)(1),
(2), (4) Date: Dec. 17, 2002

(87) PCT Pub. No.: WO02/00518

PCT Pub. Date: Jan. 3, 2002

(65) Prior Publication Data

US 2003/0168373 A1 Sep. 11, 2003

(30) Foreign Application Priority Data

Jun. 30, 2000 (FR) ..... 00 08481

(51) Int. Cl.[7] ..... B69D 69/00

(52) U.S. Cl. ..... 206/232; 206/449; 206/497; 206/813; 428/34.9

(58) Field of Search ..... 206/232, 425, 206/449, 459.1, 459.5, 497, 831, 534, 807, 460, 813; 40/306, 310, 312; 215/228, 230; 428/34.9, 35.1

(56) References Cited

U.S. PATENT DOCUMENTS

| | | | | | |
|---|---|---|---|---|---|
| 3,926,361 | A | * | 12/1975 | Hilderbrand | 206/232 |
| 4,318,235 | A | * | 3/1982 | Augeri | 40/310 |
| 4,727,667 | A | * | 3/1988 | Ingle | 40/306 |
| 5,495,944 | A | * | 3/1996 | Lermer | 206/497 |
| 5,788,076 | A | * | 8/1998 | Simmons | 206/497 |
| 6,322,864 | B1 | * | 11/2001 | Fresnel | 206/497 |

FOREIGN PATENT DOCUMENTS

EP 0775643 5/1997

* cited by examiner

*Primary Examiner*—Luan K. Bui
(74) *Attorney, Agent, or Firm*—McCormick, Pauldin & Huber LLP

(57) ABSTRACT

The invention relates to an envelope (100) for packaging at least one article, the envelope being of the type constituted by a sleeve of heat-shrink plastics material having a main portion (101) suitable for encapsulating at least a portion of the article or a group of articles, said sleeve also having an additional flap (102) overlapping the outside of the sleeve and connected to the main portion (101) of the sleeve via two parallel lines of heat sealing (102, 105) at its lateral ends, said flap having a panel-forming portion (115) which is detachable by being torn off. In accordance with the invention, at least one adhesive strip (120) extending along a generator line of the sleeve is provided on the outside face of the main portion (101) or on the inside face of the additional flap (103), said strip serving to retain a flat item (10) in the pocket formed by said additional flap, in such a manner that said item is held captive behind the detachable panel (115) and is recoverable once said panel has been detached.

15 Claims, 4 Drawing Sheets

ENVELOPE FOR PACKAGING AT LEAST ONE ARTICLE, THE ENVELOPE BEING OF THE TYPE CONSTITUTED BY A SLEEVE OF HEAT SHRINK PLASTIC MATERIAL

This application is entitled to the benefit of and incorporates by reference essential subject matter disclosed in PCT/FR01/01851 filed on Jun. 14, 2001.

The present invention relates to packaging articles, and in particular to packaging consumer products such as food, chemicals, cosmetics, or pharmaceuticals, all of which generally require consumer or user information to be provided, or indeed other information of a purely commercial nature.

More precisely, the invention relates to an envelope for packaging at least one article, the envelope being of the type constituted by a sleeve of heat-shrink plastics material having a main portion suitable for encapsulating at least a portion of the article or a group of articles, said sleeve also having an additional flap overlapping the outside of the sleeve and connected to the main portion of the sleeve via two parallel lines of heat sealing at its lateral ends, said flap having a panel-forming portion which is detachable by being torn off.

BACKGROUND OF THE INVENTION

An envelope of that type is described in document EP-A-0 670 807 in the name of the Applicant, said envelope having an additional flap defining a panel which can be detached by tearing along two parallel lines extending along generator lines of the sleeve. The additional flap co-operates with the facing face of the main portion of the sleeve to form a pocket for containing instructions constituted by one or more sheets. Under such circumstances, the detachable panel constitutes practically all of the additional flap.

That document shows clearly the state of the art concerning the use of an envelope of heat-shrink plastics material having an additional flap, carrying instructions placed in the pocket which the flap forms together with the sleeve.

Document EP-A-0 775 643 in the name of the Applicant shows a variant of the above envelope having an additional flap in which the panel can be detached by tearing along two parallel lines extending in a circumferential direction of the sleeve, by pulling on an associated end tongue, and by tearing along a line of perforations or the like extending along a generator line of the sleeve. In that case also, the additional flap co-operates with the main portion of the sleeve to define a pocket in which instructions are inserted, with access to the instructions being obtained after the panel has been detached.

Until now, the instructions associated with the envelopes shown in the above-cited documents have needed to be inserted manually while forming the sleeve, prior to the sleeve being placed on the article(s) concerned and prior to the sleeve that has been formed being subjected to heat-shrinking. Such manual insertion requires the presence of a specialized work force that has been trained on site, and that slows down rates of manufacturing throughput and represents a non-negligible fraction in the total cost of making such envelopes.

Another drawback exists if it is desired for the pocket defined by the additional flap and the main portion of the sleeve to contain a flat item of greater thickness, for example an item that is a few millimeters thick. In addition to the difficulties associated with manual insertion, a flat item of considerable thickness for insertion into the pocket leads to significant local deformation of the wall of the main portion of the sleeve, thus disturbing the planeness of the inside face of the sleeve, and consequently possibly interfering with positioning of the sleeve on the article or group of articles concerned.

That is why instructions integrated in heat-shrink envelopes have been restricted to a few sheets only, and why booklets of recipes or books of games or other flat items, for example, have not been inserted in heat-shrink envelopes of the above-specified type having a pocket-forming flap.

OBJECTS AND SUMMARY OF THE INVENTION

An object of the invention is to improve envelopes of the above-specified type, by devising an arrangement which is compatible with flat items being placed automatically in the envelope while it is being made, and while also making it possible to put into place flat items that are of considerable thickness, such as booklets.

In accordance with the invention, this problem is solved by an envelope for packaging at least one article, the envelope being of the type constituted by a sleeve of heat-shrink plastics material having a main portion suitable for encapsulating at least a portion of the article or a group of articles, said sleeve also having an additional flap overlapping the outside of the sleeve and connected to the main portion of the sleeve via two parallel lines of heat sealing at its lateral ends, said flap having a panel-forming portion which is detachable by being torn off, at least one adhesive strip extending along a generator line of the sleeve also being provided on the outside face of the main portion or on the inside face of the additional flap, said strip serving to retain a flat item in the pocket formed by said additional flap, in such a manner that said item is held captive behind the detachable panel and is recoverable once said panel has been detached.

In a first embodiment, the adhesive strip is a separate piece which extends along the full height of the sleeve. This is then entirely compatible with obtaining an envelope by cutting off a segment from a continuous reel presenting the separate adhesive strip in question extending in the length direction of the segment.

In which case, the separate adhesive strip is advantageously adhesive on both faces. Naturally, it is possible to provide a peel-off strip on the separate adhesive strip while it is still on the reel from which the corresponding segment is taken for making the envelope of the invention.

It is also possible to provide for the separate adhesive strip to be a single strip and of a width that is less than the width of the flat item.

In another embodiment, the adhesive strip is not a separate piece but is constituted by at least one line of adhesive deposited on the face concerned. The or each line of adhesive is preferably constituted by a hot-melt adhesive.

The, or at least one of the, adhesive lines may be continuous, extending over the full height of the sleeve, or discontinuous, presenting prepositioned segments, and may have any type of predetermined profile, rectilinear or otherwise.

Below, the term "adhesive strip" is used to cover not only a strip constituted by a separate piece, but also one or more lines of adhesive deposited on the face concerned.

Also preferably, the inside wall of the flap adheres to the facing outside wall of the main portion on either side of the flat item by means of the adhesive strip extending along a generator line of the sleeve.

This characteristic is particularly advantageous for use with flat items of considerable thickness, such as booklets, insofar as said item, once the envelope has been configured into the form of a sleeve ready for putting into place, is properly held in a closed space as in a shell, while also achieving minimum deformation of the main wall of the sleeve, thus making it possible to avoid any significant interference with installing the envelope on an article or a group of articles.

Provision can be made for the panel to be detachable by tearing along two parallel lines extending in the same direction as the adhesive strip. In particular, the panel may be detachable along the entire height of the sleeve, possibly with the help of a tear string.

In a variant, provision can be made for the panel to be detachable by tearing along two parallel lines extending in a circumferential direction of the sleeve, by pulling on an associated end tongue, and for it to be tearable along a line of perforations or the like extending in the same direction as the adhesive strip.

The flat item concerned may be essentially rigid, or it may present a degree of flexibility in a circumferential direction of the sleeve. As a particular example, the flat item may be constituted by a booklet or the like suitable for presenting recipes or games.

BRIEF DESCRIPTION OF THE DRAWINGS

Other characteristics and advantages of the invention appear more clearly in the light of the following description and the accompanying drawings, relating to particular embodiments, and given with reference to the figures in which.

MORE DETAILED DESCRIPTION

Figure 1:
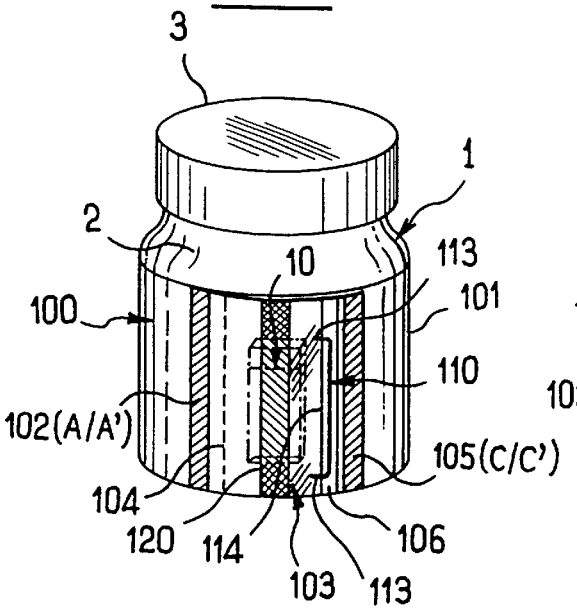
FIG. 1 is a perspective view showing a container packed in an envelope of the invention, with the additional flap thereof holding a booklet in the pocket that it forms together with the sleeve, said envelope also being fitted with an adhesive strip, in this case constituted by a separate piece provided on the outside face of the main portion of the sleeve.

FIG. 1 shows a container 1 encapsulated in an envelope of the invention referenced 100. In this case, the container 1 comprises a body 2 and a closure cap 3, and the packaging envelope 100 fits closely round the body of the container due to the envelope being heat-shrunk onto the body.

Naturally, such a container is shown merely by way of example in order to illustrate a particular case of an article packaged by means of an envelope of the invention.

The envelope 100 is constituted by a sleeve of heat-shrink plastics material, and it comprises a main portion 101 encapsulating the body of the container 1, together with an additional flap 103 overlapping the outside of the main portion 101 of the sleeve and being connected thereto via its two lateral ends by two parallel lines of heat sealing 102 and 105.

In conventional manner, the additional flap 103 cooperates with the main portion 101 of the sleeve to define a pocket in which there is received a flat item 10, for example a booklet. Nevertheless, the booklet is much thicker than is possible for the instruction sheets in the prior art. By way of example it is entirely possible for the booklet to be 5 millimeters (mm) to 10 mm thick.

Specifically, the additional flap 103 has a panel-forming portion 115 which is detachable by being torn off, in this case along two parallel lines (lines 116 in FIGS. 2 and 3) extending in a circumferential direction of the sleeve, by pulling on an associated end tongue 114 defined by a cutout 110, and by tearing along a line of perforations 104 or the like extending along a generator line of the sleeve.

A reinforcing strip 106 is also provided at the pull tongue 114 in order to ensure that said tongue 114 does not suffer during shrinking of the envelope, as taught in above-mentioned document EP-A-0 775 643.

In accordance with a characteristic of the invention, an adhesive strip 120 extending along a generator line of the sleeve is provided on the outside face of the main portion 101, said strip serving to retain the flat item 10 in the pocket formed by said additional flap in such a manner that said item is held captive behind the detachable panel 115 and can be recovered once said panel itself has been detached.

Figure 2:
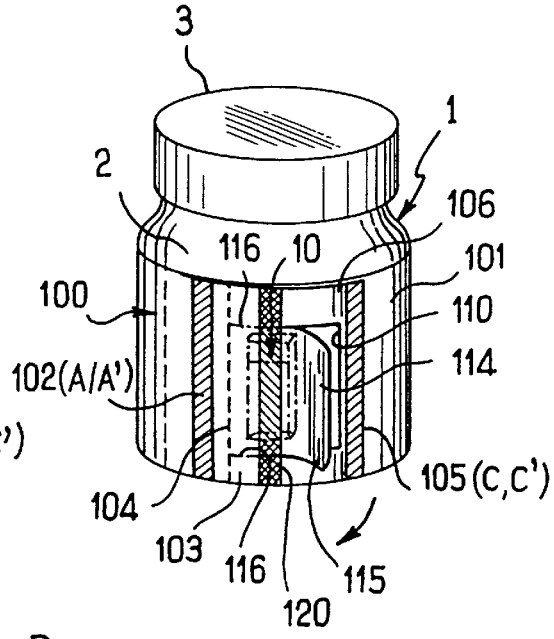
FIGS. 2 and 3 show a panel being progressively separated by tearing the corresponding zone of the additional flap until said panel is torn-off and the booklet is released.

In FIG. 2, the tongue 114 has started to be pulled away so as to begin tearing the corresponding portion of the additional flap 103, thereby enlarging the two slits 113 defining the ends of the pull tongue 114. Tearing then takes place along two circumferential lines 116, until reaching the line of perforations 104.

Figure 3:
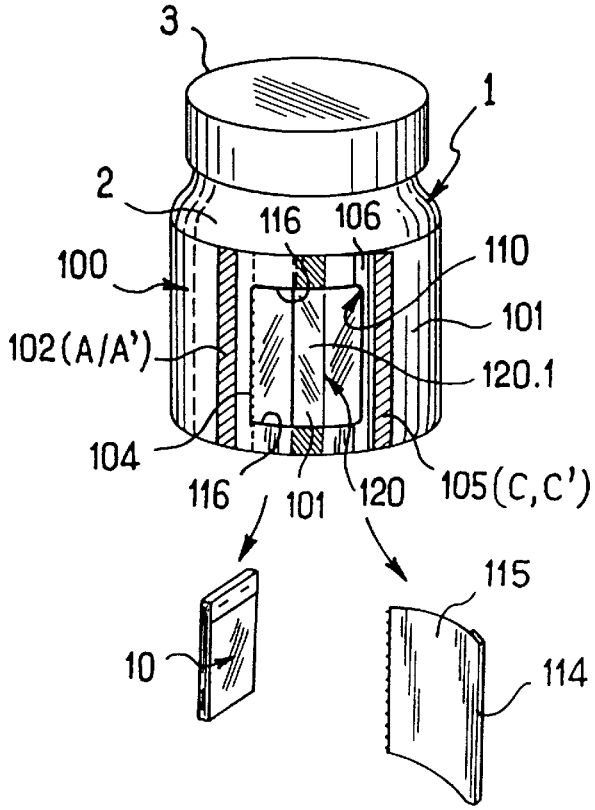

In FIG. 3, the panel 115 has been completely separated by tearing the wall of the flap 103 as far as the line of perforations 104, thus giving access to the flat item 10 and detaching it from the adhesive strip 120, as represented by arrows.

Specifically, the adhesive strip 120 is a separate piece which extends over the full height of the sleeve. It is preferably a separate strip which is adhesive on both faces, where such a strip is placed on one face of a reel of film from which a portion that is to constitute the desired envelope is unreeled and a segment cut off so as to constitute the envelope in its developed flat state. The length of the cut-off segment then corresponds to the height of the sleeve of the envelope.

It can be seen that in this case the separate adhesive strip 120 is a single strip and of a width which is narrower than the width of the flat item 10.

Naturally, in a variant, it would equally be possible to provide a plurality of juxtaposed separate adhesive strips 120 extending parallel to the direction of generator lines of the sleeve, each of these strips then preferably extending along the full height of said sleeve.

As described below with reference to FIGS. 11 to 15, the separate adhesive strip could be replaced by an adhesive strip constituted by at least one line of adhesive deposited on the corresponding face.

The term "adhesive strip" is thus used herein to cover both possibilities.

Figure 4:
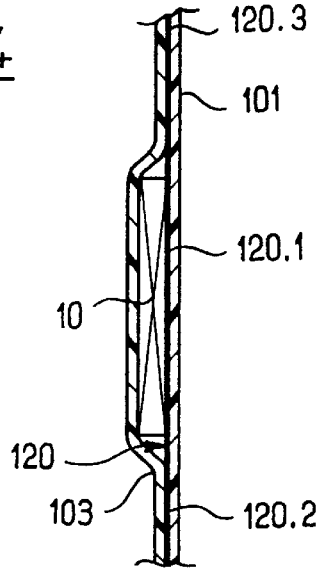
FIG. 4 is a fragmentary section view in a plane containing the axis of the container, showing the zone of the flat item held captive in the pocket.

As can be seen in the section of FIG. 4, it is advantageous to provide for the inside wall of the flap 103 to adhere by means of the adhesive strip 120 to the facing outside wall of the main portion 101 on either side of the flat item 10 along the generator line of the sleeve in question.

Thus, the adhesive strip 120 presents a central zone referenced 120.1 against which the flat item 10 adheres, and two adhesive zones 120.2 and 120.3 extending on either side of said item 10. These zones 120.2 and 120.3 enable facing portions of the additional flap 103 to adhere directly to the main portion 101, thereby forming a genuine enclosure holding the flat item 10 captive.

Thus, the flat item is held reliably in position relative to the height of the sleeve, and this is entirely compatible with flat items being put into place automatically by appropriate means while the strip of film fitted with its continuous adhesive strip is being unreeled.

In addition, there is another advantage that is far from negligible. This arrangement turns out to be compatible with the flat items being of quite considerable thickness, for example booklets that are several millimeters thick, without significantly deforming the planeness of the inside face of the main wall 101, and thus avoiding any risk of significant interference with placing the shaped sleeve on an article or a group of articles to be packaged.

It is clear that this adhesion on either side of the flat item 10 is not incompatible in any way with detaching the panel from the heat-shrink envelope by means of a tearing procedure as described above.

Figure 5:
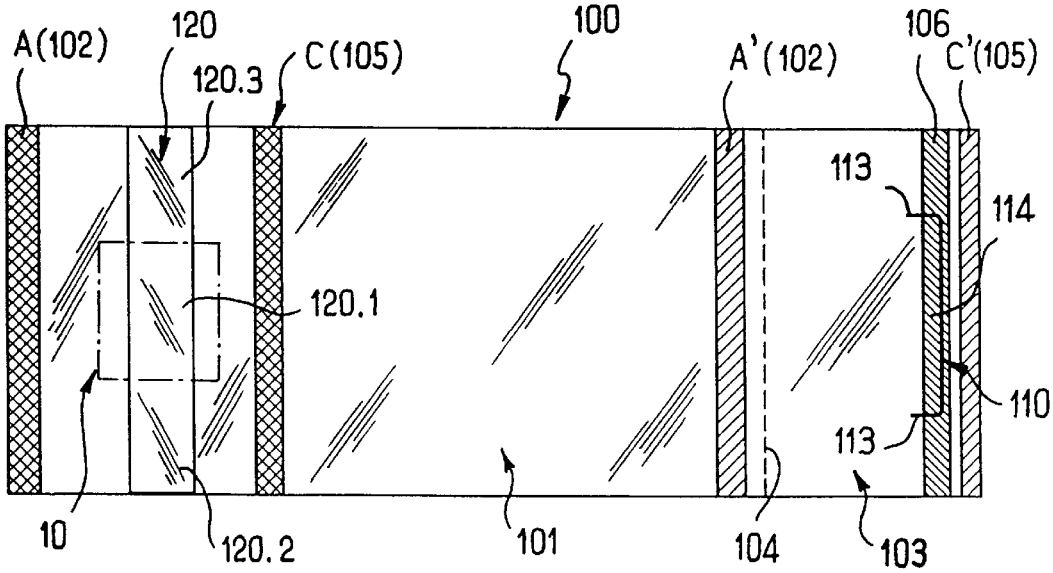
FIG. 5 is a plan view of the developed outside face of the above-mentioned envelope prior to the booklet being put into place (its outline is represented by chain-dotted lines), and prior to the envelope being shaped into the form of a sleeve.

The plan view of FIG. 5 showing the developed outside face of the above-mentioned envelope 100 reveals the main portion 101 with its two zones referenced A, A' that are associated with the line of heat sealing 102, and its two zones C, C' associated with the line of heat sealing 105. In this figure, the zones A' and C' are represented by single shading to indicate that these zones are on the rear face, i.e. on the inside face of the envelope, while the zones A and C are represented by cross hatching to indicate that these zones are on the front face, i.e. the outside face of the wall.

There can also be seen the additional flap 103 which in this case is connected to the main portion 101 of the envelope via the line of perforations 104. The additional flap has a terminal zone C' associated with the above-mentioned zone C for forming the line of heat sealing 105. The additional flap 103 also presents a cutout 110 defining the pull tongue 114 with its tear-initiating slits 113, the reinforcing strip 106 being provided on the other side, i.e. on the inside face of the developed envelope.

There can also be seen on the outside face of the main portion 101, the adhesive strip 120, in this case a separate strip, which extends over the full height of the sleeve between the zones A and C.

The separate adhesive strip 120 presents three successive zones, i.e. a central zone 120.1 against which the flat item in question is to be applied, and zones 120.2 and 120.3 extending beyond the outline of the item in the direction of generator lines of the sleeve, and against which the facing walls of the additional flap 103 are applied once the sleeve has been shaped.

Thus, as can readily be understood, when the envelope 100 is shaped to form a sleeve, the zones A and A' are superposed to form the line of heat sealing 102 and the zones C and C' are superposed to form the line of heat sealing 105.

Naturally, the item 10 is put into place, preferably by automatic means, on the central portion 120.1 of the adhesive strip 120 prior to the additional flap 103 being superposed on the main portion 101, and prior to making the second line of heat sealing 105.

The embodiment described above merely constitutes one example of the invention, and it is possible to envisage numerous variants based on the same inventive concept and coming within the ambit of the invention.

Figure 6:
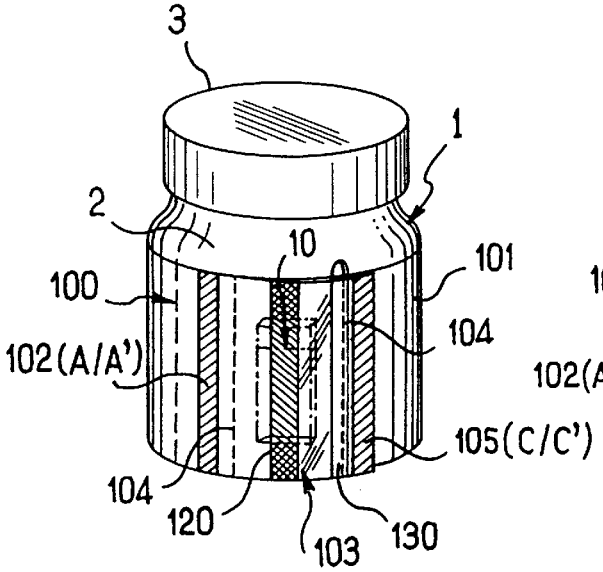
FIGS. 6 and 7 are perspective views analogous to the views of FIGS. 1 and 3 showing a variant of the preceding envelope in which the panel is detachable up its entire height along two lines that extend along generator lines of the sleeve.
Figure 7:
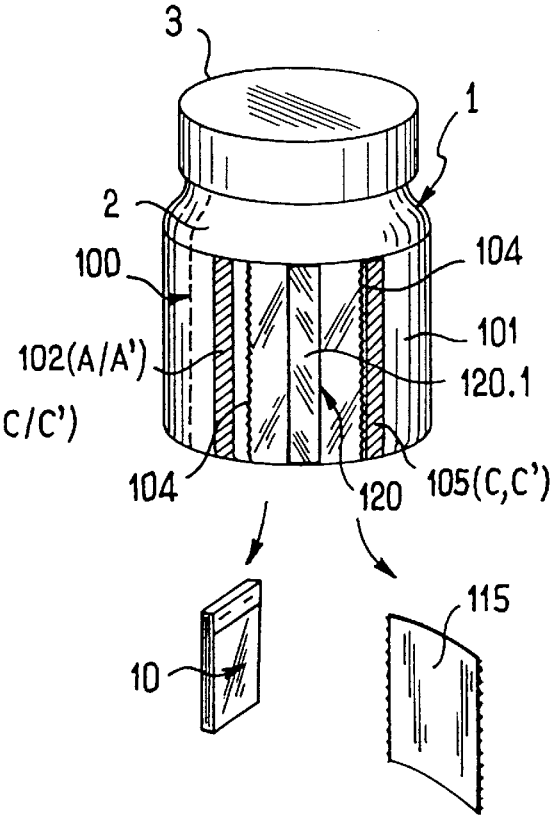

Thus, as shown in FIGS. 6 and 7, in a variant it is possible to provide for the panel 115 of the additional flap 103 to be detachable by tearing along two parallel lines which extend in the same direction as the adhesive strip 120.

In FIGS. 6 and 7, means that have already been described with reference to FIGS. 1 and 2 retain the same references. There can now be seen a flap 103 presenting two lines of perforations or the like 104, and fitted with a tear string 130 extending along a generator line of the sleeve, in this case being placed close to the line of heat sealing 105.

In this case also, an adhesive strip 120 extending along a generator line of the sleeve over the full height of said sleeve is provided on the outside face of the main portion 101, having the same function and providing the same technical results as described above. Such a panel which can be detached over its full height is already taught in the above-mentioned document EP-A-0 670 807 in the name of the Applicant.

Specifically, a single adhesive strip 120 is provided at substantially equal distances between the two lines of perforations 104. Naturally, in a variant, it is possible to provide a plurality of parallel adhesive strips performing the same function (these variants are not shown herein). Once the panel 115 has been detached, it is easy to access the flat item 10, as shown in FIG. 7.

Figure 8:
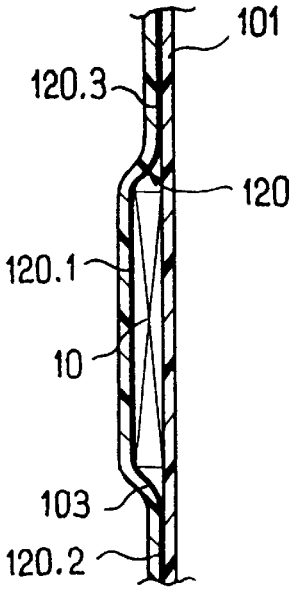
FIGS. 8 to 10 are section views analogous to the view of FIG. 4, showing other situations for positioning the adhesive strip and the flat item in the height direction of the sleeve.

Furthermore, as shown in FIG. 8, it is possible in a variant to provide for the adhesive strip 120 to be provided on the inside face of the additional flap 103. Although more difficult to implement, this variant makes it possible as before to define a pocket in the form of a shell that holds the flat item 10 properly in place with the facing walls on either side of said item adhering to each other via the zones 120.2 and 120.3 of the adhesive strip 120. Under such circumstances, the adhesive strip 120 is preferably located halfway between the zones A' and C' defining the additional flap 103.

Figure 9:
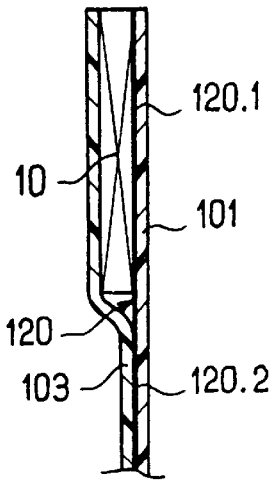
Figure 10:
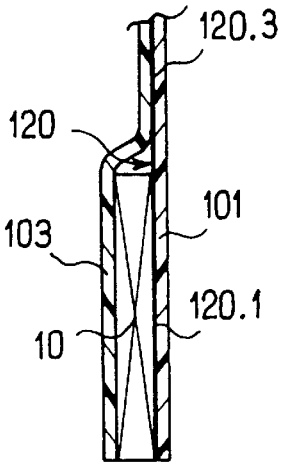

As mentioned above, adhesion between the inside wall of the flap 103 and the facing outside wall of the main portion 101 on either side of the flat item 10 is particularly advantageous when said flat item is of significant thickness. Nevertheless, particularly if the flat item is of small thickness, it is also possible to provide a disposition in which said item is located at the top or bottom zone of the main portion 101 of the sleeve, as shown respectively in the sections of FIGS. 9 and 10.

Other embodiments are described below with reference to FIGS. 11 to 15, in which the adhesive strip 120 is not constituted by a separate strip but is constituted instead by at least one line of adhesive deposited on the corresponding face (the outside face of the main portion 101 or the inside face of the additional flap 103).

The adhesive used for constituting the line(s) of adhesive is preferably a hot-melt adhesive.

Such an adhesive is then deposited by any appropriate coating system constituted by one or more nozzles possibly driven to provide a particular shape or pattern.

Figure 11:
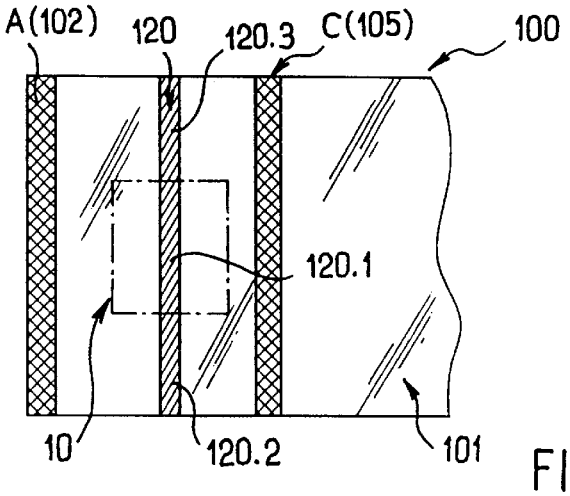
FIGS. 11 to 15 are fragmentary plan views of the developed outside face of the envelope, showing several variants in which the adhesive strip is constituted by at least one line of adhesive deposited on the corresponding face.
Figure 12:
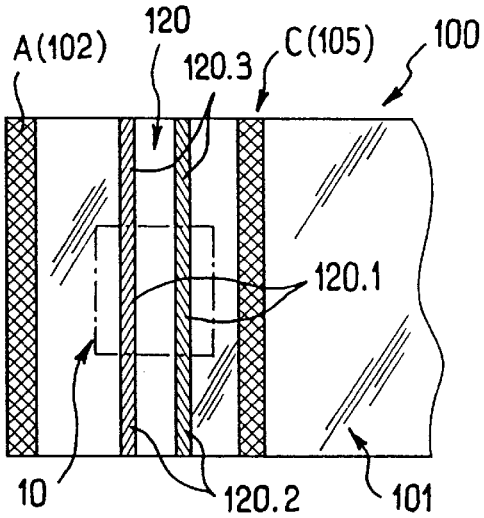
Figure 13:
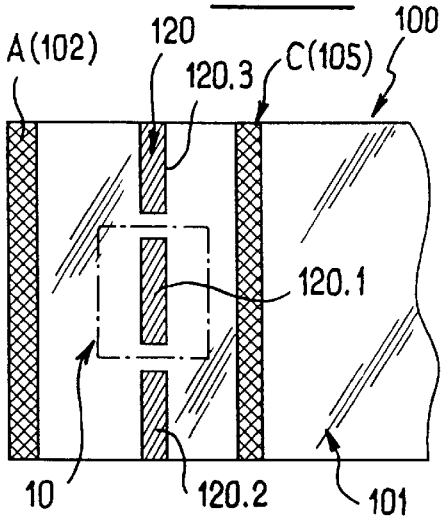
Figure 14:
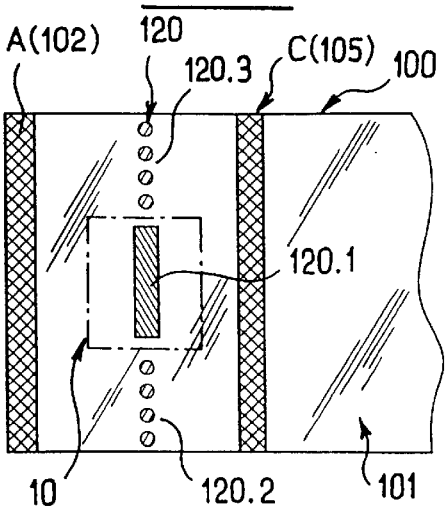
Figure 15:
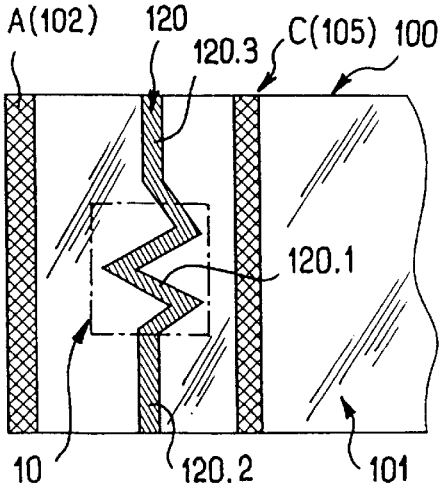

FIGS. 11 to 15 are fragmentary views that should be compared with FIG. 5, and they retain the same numerical references, so it is only the arrangement of the adhesive strip 120 constituted by one or more lines of adhesive that is described below:

FIG. 11: there is a single line of adhesive which is continuous and which extends over the full height of the sleeve;

FIG. 12: there are two continuous lines of adhesive, they are parallel and juxtaposed;

FIG. 13: there is a discontinuous line of adhesive presenting three prepositioned segments, namely a central segment 120.1 which is associated with holding the corresponding item, and end segments 120.2 and 120.3 serving to prevent the sleeve opening in untimely manner after it has shrunk;

FIG. 14: a different type of discontinuous adhesive line is provided in which the end segments 120.2 and 120.3 comprise a series of spots; and FIG. 15: a line of adhesive is provided of non-rectilinear shape, with a central portion 120.1 associated with holding the item that is in the form of a zigzag.

These non-limiting examples show that the fixing of the item can be optimized as a function of the type of item concerned, and in particular a very thick booklet can be accommodated as can a booklet having different thicknesses on opposite sides. This thus makes it possible to control the behavior of the shaped envelope during shrinking.

Furthermore, although not shown herein, it is also possible to provide an envelope for packaging a group of articles, as described in above-mentioned document EP-A-0 775 643 in the name of the Applicant. Under such circumstances, a sleeve is used having two compartments, with a second line of heat sealing arranged at a distance from the line of heat sealing 202 so as to define an intermediate diaphragm. The organization of the additional flap 103 and the arrangement of the adhesive strip 120 remain unchanged.

Finally, numerous other variants can be provided that differ from the above in the way in which the detachable panel is arranged, likewise as described in the above-cited documents.

An envelope is thus provided in which the additional flap is suitable for containing a flat item of considerable thickness, which flat item is preferably somewhat flexible in the circumferential direction of the sleeve, for example it might be constituted by a booklet. The wide variety of ways in which the detachable panel and the adhesive strip(s) can be arranged and dimensioned make it possible to adapt the packaging to a wide variety of different situations as required.

The invention is not limited to the embodiments described above, but on the contrary covers any variant using equivalent means to reproduce the essential characteristics specified above.

What is claimed is:

1. An envelope for packaging at least one article, the envelope being of the type constituted by a sleeve of heat-shrink plastics material having a main portion suitable for encapsulating at least a portion of the article or a group of articles, said sleeve also having an additional flap overlapping the outside of the sleeve and connected to the main portion of the sleeve via two parallel lines of heat sealing at its lateral ends, said flap having a panel-forming portion which is detachable by being torn off, wherein at least one adhesive strip extending along a generator line of the sleeve is provided on the outside face of the main portion or on the inside face of the additional flap, said strip serving to retain a flat item in the pocket formed by said additional flap, in such a manner that said item is held captive behind the detachable panel and is recoverable once said panel has been detached.

2. An envelope according to claim 1, wherein the adhesive strip is a separate piece which extends along the full height of the sleeve.

3. An envelope according to claim 2, wherein the separate adhesive strip is adhesive on both faces.

4. An envelope according to claim 2, wherein the separate adhesive strip is a single strip and of a width which is narrower than the width of the flat item.

5. An envelope according to claim 1, wherein the adhesive strip is constituted by at least one line of adhesive deposited on the corresponding face.

6. An envelope according to claim 5, wherein the or each line of adhesive is constituted by a hot-melt adhesive.

7. An envelope according to claim 5, wherein the or at least one of the lines of adhesive is continuous and extends along the full height of the sleeve.

8. An envelope according to claim 5, wherein the or at least one of the lines of adhesive is discontinuous and presents prepositioned segments.

9. An envelope according to claim 5, wherein the or at least one of the lines of adhesive is of predetermined profile, rectilinear or otherwise.

10. An envelope according to claim 1, wherein the inside wall of the flap adheres to the facing outside wall of the main portion on either side of the flat item by means of the adhesive strip extending along a generator line of the sleeve.

11. An envelope according to claim 1, wherein the panel is detachable by tearing along two parallel lines extending in the same direction as the adhesive strip.

12. An envelope according to claim 11, wherein the panel is detachable over the full height of the sleeve, possibly with help from a tear string.

13. An envelope according to claim 1, wherein the panel is detachable by tearing along two parallel lines extending in a circumferential direction of the sleeve, by pulling on an associated end tongue, and along a line of perforations or the like extending in the same direction as the adhesive strip.

14. An envelope according to claim 1, wherein the flat item is somewhat flexible in the circumferential direction of the sleeve.

15. An envelope according to claim 14, wherein the flat item is a booklet.

* * * * *